United States Patent [19]

Sauer

[11] 4,122,774

[45] Oct. 31, 1978

[54] BLANKET CLAMPING APPARATUS

[75] Inventor: Hartmut K. Sauer, Himmelstadt, Fed. Rep. of Germany

[73] Assignee: Koenig & Bauer Aktiengesellschaft, Wurzburg, Fed. Rep. of Germany

[21] Appl. No.: 800,115

[22] Filed: May 24, 1977

[30] Foreign Application Priority Data

Jul. 10, 1976 [DE] Fed. Rep. of Germany ..... 2631119

[51] Int. Cl.[2] ..... B41F 27/00

[52] U.S. Cl. ..... 101/415.1; 101/378

[58] Field of Search ..... 101/415.1, 378; 51/364–371, 380, 389

[56] References Cited

U.S. PATENT DOCUMENTS

| | | | |
|---|---|---|---|
| 1,545,791 | 7/1925 | Owen | 101/415.1 |
| 1,927,049 | 9/1933 | Schmidt et al. | 101/415.1 |
| 2,121,309 | 6/1938 | Wale | 101/378 |
| 2,820,409 | 1/1958 | Johnson | 101/415.1 |
| 2,900,904 | 8/1959 | Hontscho | 101/415.1 |
| 3,119,331 | 1/1964 | Kouk et al. | 101/415.1 |
| 3,152,544 | 10/1964 | Newman | 101/415.1 |
| 3,353,481 | 11/1967 | Antonucci | 101/378 X |
| 3,818,651 | 6/1974 | Eells | 51/368 |

*Primary Examiner*—Edward M. Coven
*Attorney, Agent, or Firm*—Jones, Tullar & Cooper

[57] ABSTRACT

A blanket clamping and tensioning apparatus for use in a blanket cylinder in a rotary printing press is disclosed. An axial groove at the periphery of the blanket cylinder carries a pair of spaced inserts which define an interior chamber. A radially movable clamping bar assembly is carried within the chamber and contacts camming surfaces on the inserts. The ends of the blanket are inserted in the space between the inserts and the clamping bar assembly is moved radially inwardly thereby camming clamping means toward each other to grip the blanket. Four embodiments are disclosed in which there are shown different gripping portions of the clamping bar assemblies.

18 Claims, 9 Drawing Figures

BLANKET CLAMPING APPARATUS

FIELD OF THE INVENTION

The present invention is directed generally to a blanket clamping apparatus for the blanket cylinder of a rotary printing press. More particularly, the present invention is directed to such a blanket clamping apparatus having a radially moving clamping bar assembly. Most particularly, the blanket clamping apparatus of the present invention includes a clamping bar assembly which contacts camming surfaces of inserts carried in an axial groove on the periphery of the blanket cylinder.

The axial groove at the periphery of the blanket cylinder carries a pair of spaced inserts which define a chamber within which is carried a clamping bar assembly. This clamping bar assembly rides on camming surface portion of the inserts and is radially movable to cause clamping means to clamp the ends of a blanket to the cylinder and to tension the blanket on the cylinder. Four specific embodiments of the clamping bar assembly are disclosed all of which function in a similar manner to effect the clamping and tensioning of the blanket.

DESCRIPTION OF THE PRIOR ART

Clamping apparatuses for attaching blankets to blanket cylinders in rotary printing presses are known in the prior art as may be seen, for example, in U.S. Pat. No. 2,121,309 which discloses a blanket mounting and tensioning apparatus having a radially movable clamping bar. An inherent disadvantage of devices such as this is that there must be provided a large cavity in the periphery of the blanket cylinder which carries the clamping bar which is in turn accessible through a corresponding large slot on the surface of the blanket cylinder. While plate mounting and tensioning apparatuses allow for the mounting of the plates on the form cylinders with only a small peripheral space, the blanket clamping and tensioning devices have required a substantial peripheral space. This large print-free space has limited the printing area of the rotary printing units since it is the largest peripheral space which determines the size of the print-free space and this large slot has in prior devices been caused by the relatively large slot required to afford access to the clamping means on the blanket cylinder.

SUMMARY OF THE INVENTION

It is an object of the present invention to provide a blanket clamping and tensioning apparatus which requires little peripheral space on the blanket cylinder.

It is a further object of the present invention to provide a blanket clamping and tensioning apparatus which requires a slot only slightly larger than the thickness of the two ends of the blanket.

Yet another object of the present invention is to provide a blanket clamping and tensioning apparatus which is of rugged and uncomplicated construction and which is simple in operation.

As will be discussed in more detail in the description of preferred embodiments, the blanket clamping and tensioning apparatus in accordance with the present invention is comprised generally of a pair of inserts carried in an axial groove at the periphery of a blanket cylinder. The inserts define an interior chamber which communicates with the periphery of the cylinder by means of a slot. A clamping bar assembly is carried within the chamber and is readily movable therewithin. The chamber walls defined by the inserts include camming surfaces which contact the clamping bar assembly whereby radial movement of the clamping bar assembly causes clamping means to move toward or away from each other. The blanket's leading and trailing edges pass through the slot and into the space between the clamp means so that the blanket can be clamped and tensioned by radial movement of the clamp bar assembly.

This blanket clamping and tensioning apparatus requires an axial slot of only minimum width in the blanket cylinder periphery with this slot being only slightly wider than the thickness of the ends of the blanket thereby limiting the loss of effective printing space to a small amount. In addition, the blanket can be clamped and tensioned by one actuating means and in one procedure.

BRIEF DESCRIPTION OF THE DRAWINGS

While the novel features of the present invention are set forth with particularity in the appended claims, the invention will be understood more fully and completely from the detailed description of the preferred embodiments of the invention and as may be seen in the accompanying drawings in which:

DESCRIPTION OF PREFERRED EMBODIMENTS

Figure 1:
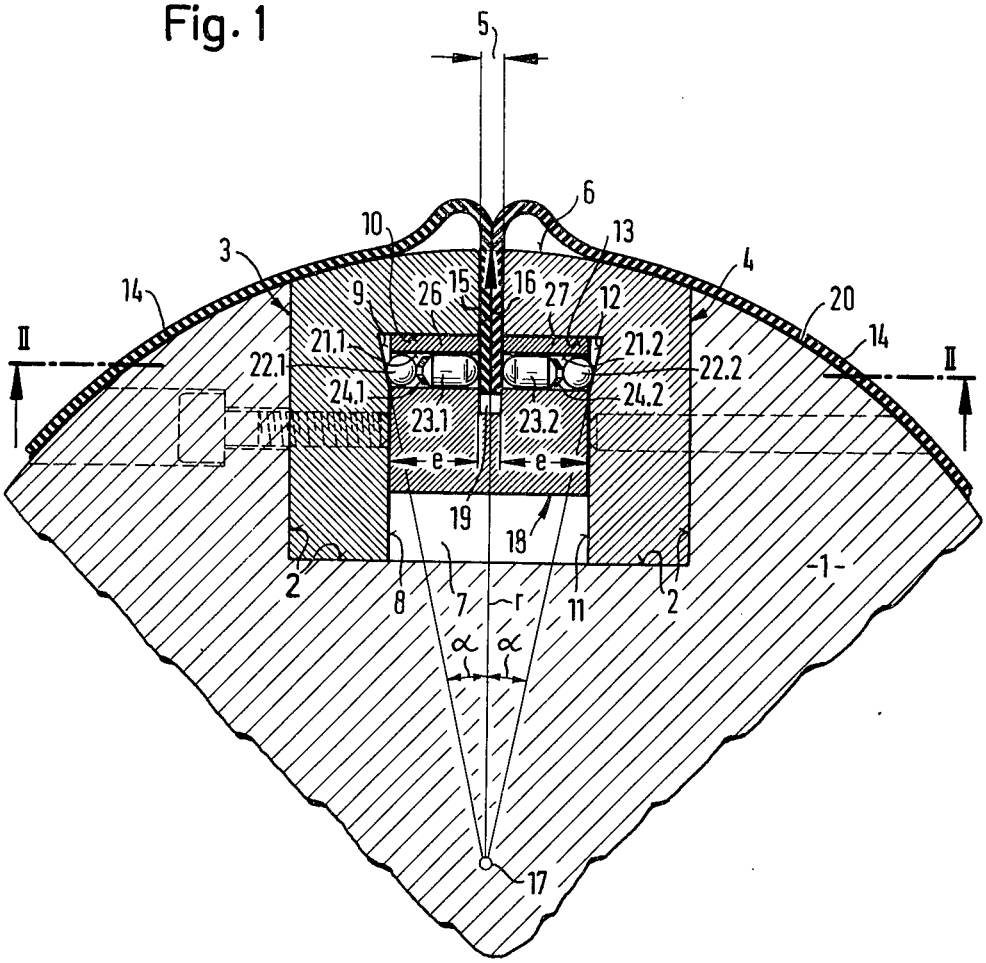
FIG. 1 is a cross section of a first embodiment of a blanket clamping and tensioning apparatus in accordance with the present invention and showing the apparatus in "open" position.

Turning now to FIG. 1, there may be seen a first embodiment of a blanket clamping and tensioning apparatus in accordance with the present invention in which there is provided a blanket cylinder 1 having a paraxial or axially extending cylinder groove 2. The cylinder groove 2 receives a pair of spaced, generally L-shaped inserts 3 and 4, which are secured to the cylinder 1 by suitable means (not shown). The inserts 3 and 4 are placed facing each other in such a manner to form a gap 5, which is open towards a surface portion 6 of the blanket cylinder 1 and communicates with a chamber 7 within the blanket cylinder 1. The chamber 7 is defined at either side by inner surfaces 8, 9, 10 of the insert 3, and inner surfaces 11, 12, 13 of the insert 4 respectively. The inner surfaces 8 and 11 of inserts 3 and 4 are disposed in such a way that they extend parallel to radius "*r*" and surfaces 9 and 12 of the inserts 3 and 4 are disposed at an angle α to radius *r*; angle α being an acute angle.

Figure 2:
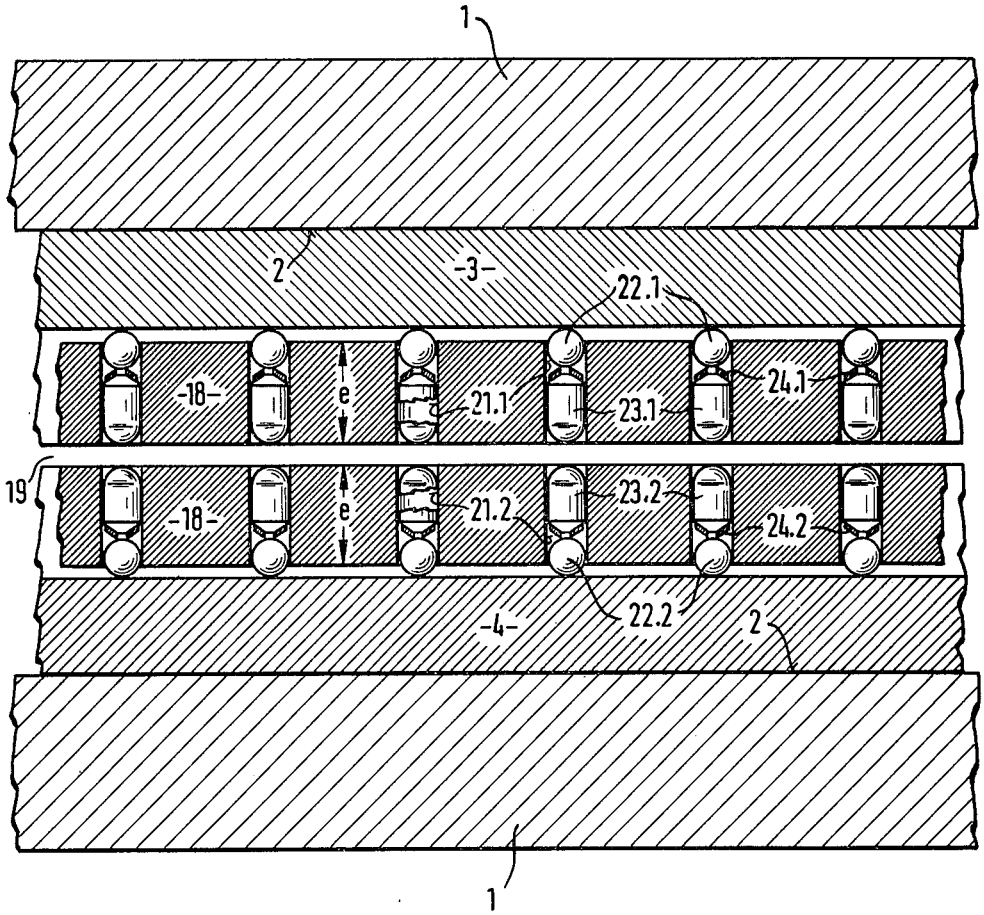
FIG. 2 is a cross sectional view taken along line II—II in FIG. 1 with the blanket removed.

FIGS. 1 and 2 show a clamp assembly bar 18 which is fitted into the chamber 7 and is capable of reciprocally moving in a radial direction along the inner surfaces 8, 9, 11 and 12. The clamp bar assembly 18 is generally U-shaped and is provided with a longitudinally slot 19, into which the edges 15 and 16 of a blanket 14 may be tucked. The clamp bar assembly 18 is furthermore provided with a plurality of horizontal bores 21.1, 21.2, which all end in the longitudinal slot 19. The bores 21.1 and 21.2 may be disposed either opposite each other or staggered to each other, and serve to receive clamping means 22.1, 22.2, 23.1, 23.2. In the first embodiment of the invention, as seen in FIGS. 1 and 2, the clamping means consist of balls 22.1, 22.2 and cylindrical pins 23.1, 23.2. In this case, the clamping means 22.1, 22.2, 23.1, 23.2, are fitted with springs 24.1, 24.2 and these clamping means are longer than the width "*e*" of legs 26, 27 of the clamp bar assembly 18, which receive them. The cup springs 24.1, 24.2, which are disposed between the balls 22.1, 22.2 and the cylindrical pins 23.1, 23.2, limit the clamping force, which is imparted to the blanket edges 15, 16 of the blanket 14 by means of the balls 22.1, 22.2 and the cylindrical pins 23.1, 23.2. Each of the cup springs 24.1 or 24.2 is connected in any satisfactory manner to the extremity of the cylindrical pin 23.1 or 23.2 coordinated to it, so that it cannot be lost.

In operation, when the clamp bar assembly 18 is moved in the direction of center 17 of the blanket cylinder 1, the balls 22.1, 22.2 contact the camming surfaces 9 and 12 of inserts 3 and 4, and this narrowing cross section of the chamber 7 forces the balls 22.1, 22.2 into the bores 21.1 and 21.2 to press, by means of the cup springs 24.1, 24.2, the cylindrical pins 23.1, 23.2 against the blanket edges 15, 16. During the downward motion of the clamp bar assembly 18, the surface pressure of the cylindrical pins 23.1, 23.2 onto the blanket edges 15, 16 increases sufficiently so that the edges of the blanket follow the motion of the clamp bar assembly 18, and the blanket 14 is tensioned around the periphery 20 of the blanket cylinder 1. The front surfaces of the cylindrical pins 23.1, 23.2, which are turned towards the blanket edges 15, 16 may be of hemispherical, flat, or any other surface shape.

Figure 3:
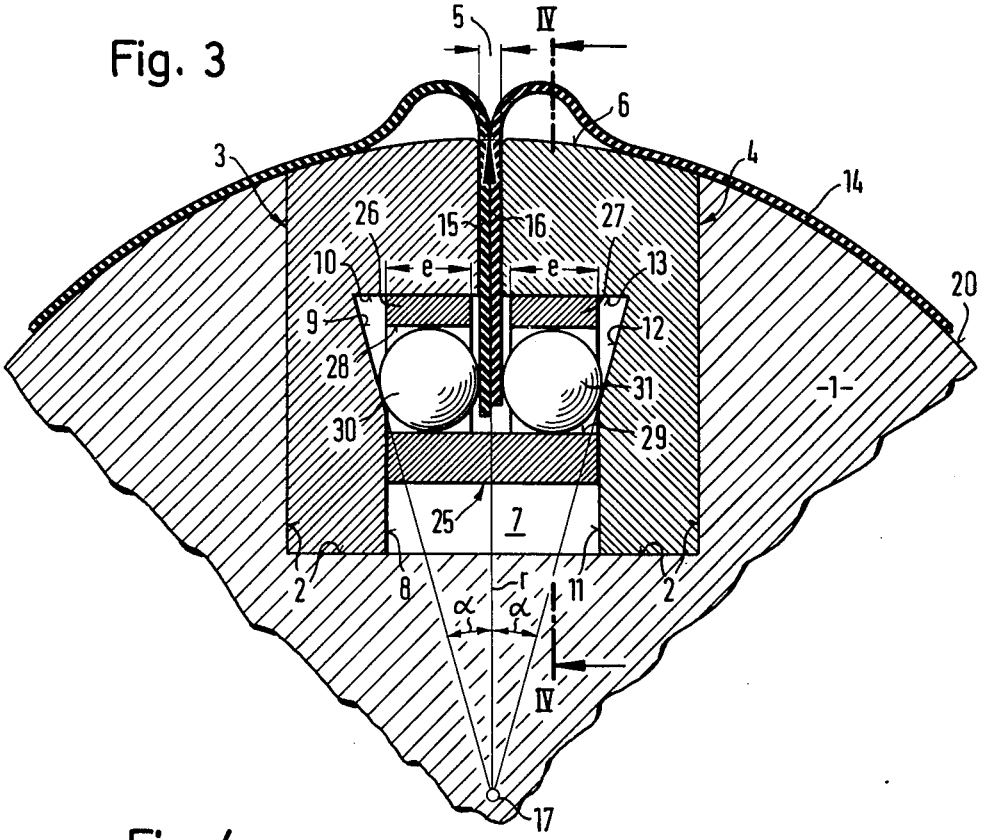
FIG. 3 is a cross section of a second embodiment of a blanket clamping and tensioning apparatus in accordance with the present invention taken along line III—III in FIG. 4, and showing the apparatus in "open" position.
Figure 4:
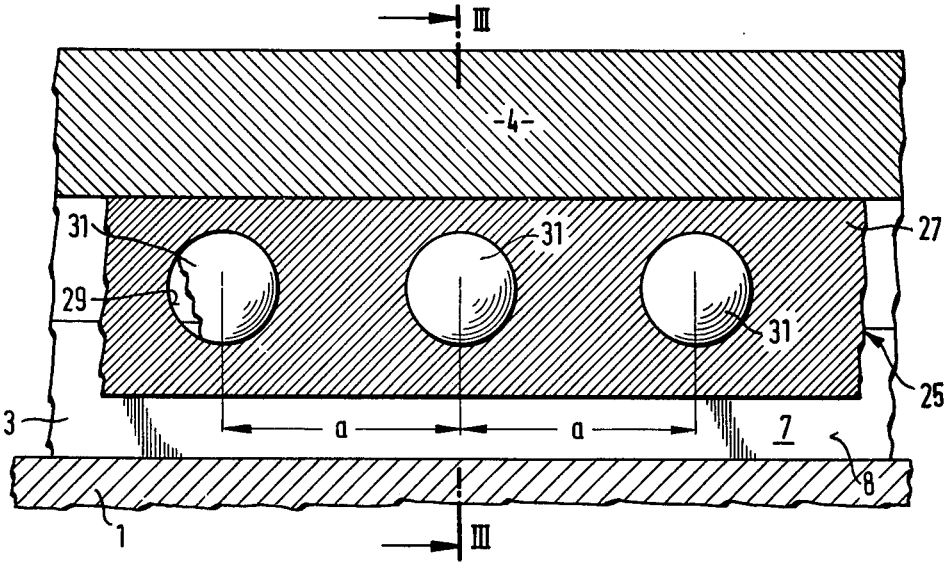
FIG. 4 is a cross sectional view taken along line IV—IV in FIG. 3, with the blanket removed.

FIGS. 3 and 4 shows a second embodiment of a blanket clamping and tensioning apparatus in accordance with the present invention. Parts 1 to 17 shown in these figures are identical with parts 1 to 17 shown in and described in connection with FIG. 1. The clamp bar assembly 25, however, differs from that of the embodiment shown according to FIG. 1, as it is U-shaped, with legs 26, 27 which are provided with a plurality of bores or recesses 28, 29 respectively, spaced from each other a distance "*a*," as may be seen in FIG. 4. In the bores or recesses 28, 29, clamping means such as balls or rollers 30, 31 are disposed. The diameter of these balls or rollers 30, 31 is greater than the width "*e*" of the relative legs 26, 27, which receive them. The balls or rollers 30, 31 press, during their motion in the direction of center 17, along the camming surfaces 9, 12 which are inclined at an angle α to radius "*r*," into the blanket edges 15, 16, so that the blanket edges 15, 16 are clamped between balls or rollers 30, 31 and are forced to follow the clamp bar assembly 25's motion in the direction of center 17, whereby the blanket 14 is tightened around the periphery 20 of the blanket cylinder 1.

Figure 5:
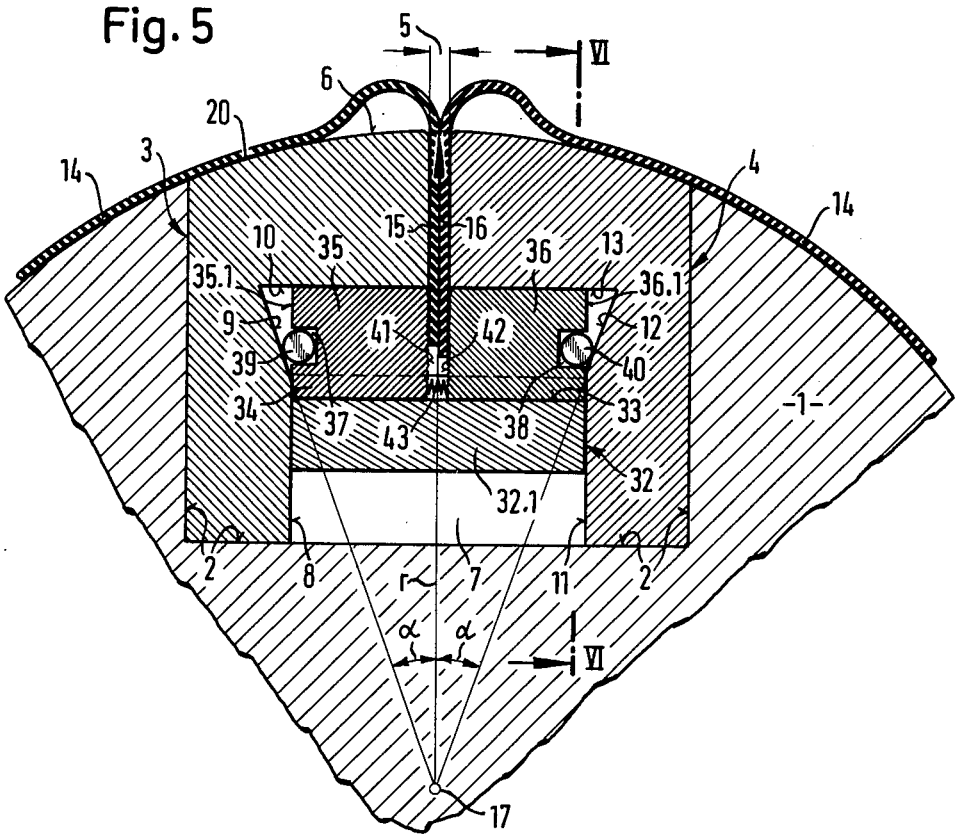
FIG. 5 is a cross section of a third embodiment of a blanket clamping and tensioning apparatus in accordance with the present invention taken along line V—V in FIG. 6, and showing the apparatus in "open" position.
Figure 6:
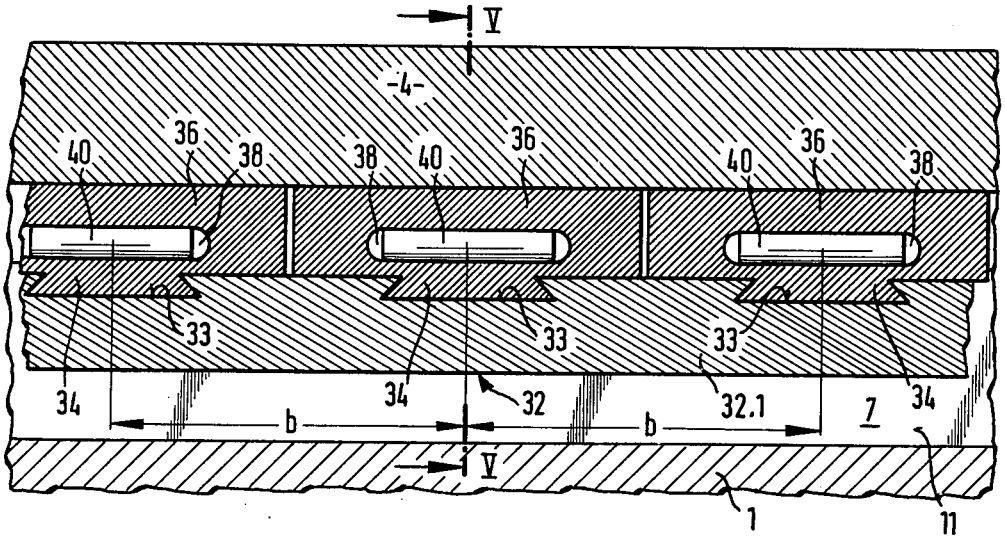
FIG. 6 is a cross sectional view taken along line VI—VI in FIG. 5, with the blanket removed.

FIGS. 5 and 6 show a third embodiment of a blanket clamping and tensioning apparatus in accordance with the present invention. As seen in FIGS. 5 and 6, parts 1 to 17 inclusive are identical with parts 1 to 17 shown in FIGS. 1 and 4. The clamp bar assembly 32, however, comprises, in this embodiment, a base plate 32.1, which carries a plurality of individual clamping blocks 35, 36, which are capable of movement crossway to the longitudinal axial direction of the base plate 32.1. A plurality of dovetail-shaped grooves 33 are spaced from each other by a distance "*b*" and extend parallel to each other, as seen in FIG. 6. Grooves 33 are positioned on the base plate 32.1 at an angle of 90° to the longitudinal axis of base plate 32. Clamping blocks 35, 36 are supported in the grooves 33 and are capable of being shifted in a horizontal direction by means of their dovetail-shaped guides 34. The clamping blocks 35, 36 are provided with recesses 37, 38 extending in a longitudinal axis direction, and these recesses 37, 38 serve to support balls or rollers 39, 40. The diameter of these balls or rollers 39, 40 is such that they project with part of their cross secton from lateral surfaces 35.1, 36.1 of the clamping blocks 35, 36 and slide along the camming surfaces 9, 12. In order to increase the coefficient of friction of clamping surface portions 41, 42 of the clamping blocks 35, 36, these clamping surfaces 41, 42 may be channelled. A compression spring 43 is disposed between the clamping blocks 35 and 36, preferably in each of the grooves 33. The compression springs 43 serve to separate the clamping blocks 35, 36 from each other when the clamp bar 32 is moved to the "open" position so that the blanket edges 15, 16 will be released. When the clamp bar 32 is moved in the direction of center 17 of the blanket cylinder 1, the balls or rollers 39, 40 slide along the camming surfaces 9 or 12 inclined at an angle α in the direction of center 17. As the surfaces 9 and 12 are inclined towards each other, thus forming a chamber 7 having a cross section which narrows towards center 17, the clamping blocks 35, 36 are shifted by means of balls or rollers 39, 40 against each other, when the clamp bar assembly 32 is moved in the direction of "tension," so that the blanket edges 15, 16 are first pressed together, and then follow the movement of the clamp bar 32 in the direction of center 17. It is obvious that instead of two rows of individual clamping blocks 35, 36 two one piece clamp bars may be used, and that these are guided by means of a plurality of dovetail-shaped guides 34 in an equal plurality of dovetail-shaped grooves 33 within the clamp bar 32.

Figure 7:
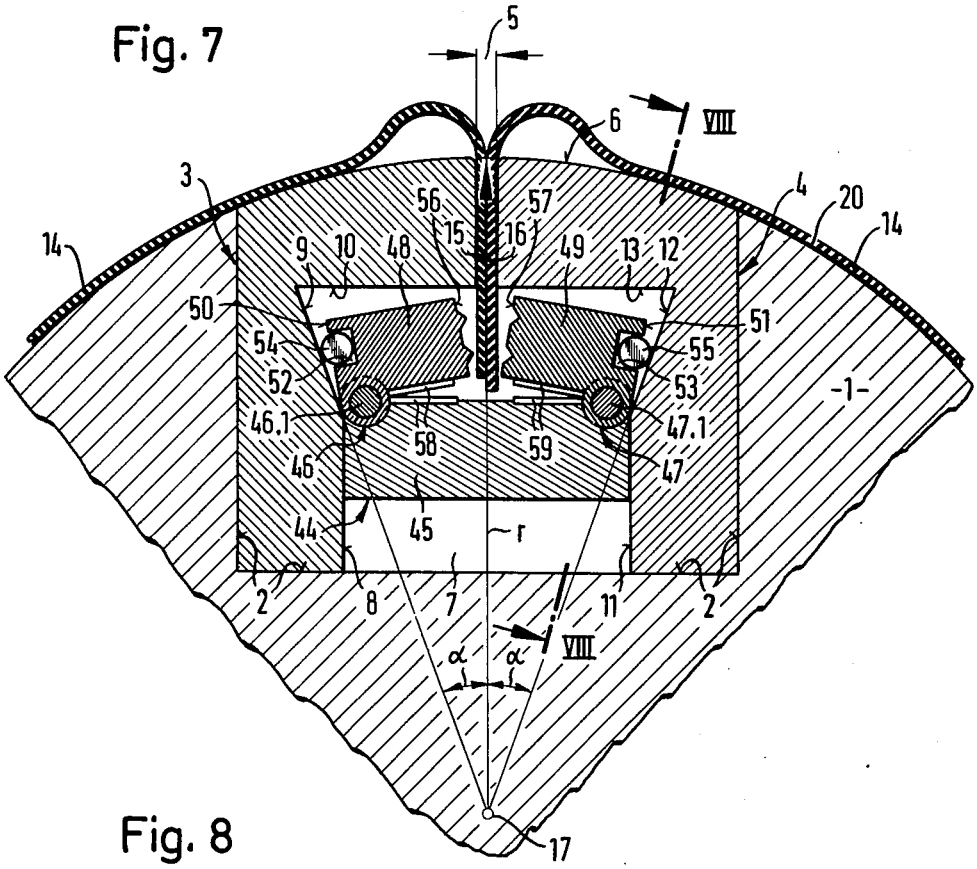
FIG. 7 is a cross section of a fourth embodiment of a blanket clamping and tensioning apparatus in accordance with the present invention and showing the apparatus in "open" position.
Figure 8:
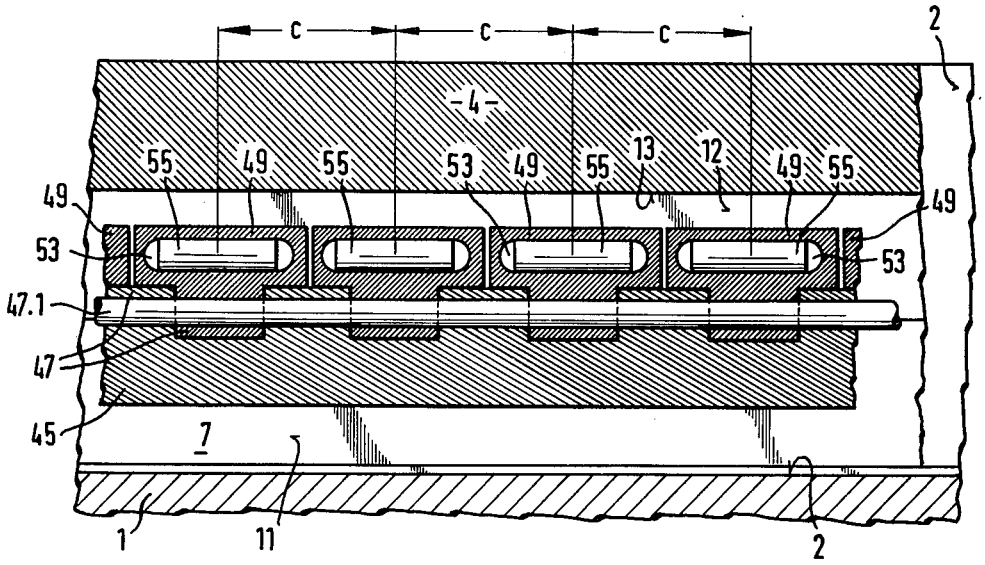
FIG. 8 is a cross sectional view taken along line VIII—VIII in FIG. 7 with the blanket removed.

FIGS. 7 and 8 shows a fourth embodiment of the present invention. In these figures, parts 1 to 17 inclusive are identical with parts 1 to 17 as described in connection with FIGS. 1 to 6. The clamp bar assembly 44 carries in this embodiment a plurality of clamping blocks or bars 48, 49. The lateral surfaces 50, 51 of the clamping blocks or bars 48, 49 facing the camming surfaces 9, 12 of the inserts 3, 4 are provided in the direction of the longitudinal axis of the base plate 45, with a plurality of recesses 52, 53 spaced at a distance "*c*" from each other. The recesses 52, 53 supports balls or rollers 54, 55, which protrude with part of their cross section from the lateral surfaces 51, 52 of the clamping blocks 48, 49 and slide along the camming surfaces 9, 12.

For maintaining the clamping blocks 48, 49 in "open" position, one compression spring 58, 59 is disposed for each of the clamping blocks 48, 49. On the base plate 45, in the direction of its longitudinal axis, a plurality of clamping blocks 48, 49 are mounted side by side, and these are capable of moving on hinges 46, 47 around the hinge axles 46.1, 47.1. The clamping blocks 48 are positioned opposite the clamping blocks 49. However, instead of the individual clamping blocks 48, 49, one part clamp bars may be utilized the lengths of which are equal to the width of several clamping blocks, and which are equipped with the same parts as are the clamping blocks 48, 49, and which are also fastened onto the clamp bar assembly 44 by means of hinges or the like. When the clamp bar assembly 44 is moved in the direction of "clamping" and "tensioning," that is to say in the direction of center 17, the balls or rollers 54, 55 slide along the camming surfaces 9 and 12 of the inserts 3, 4, which are inclined to the radius "*r*" at an angle $\alpha$. This effects movement of the clamping blocks 48, 49 on the hinge axles 46.1, 47.1 of the hinges 46, 47, whereby the blanket edges 15, 16 are pressed between the clamping surfaces 56, 57. By a further motion of the clamping blocks 48, 49 around the hinge axles 46.1, 47.1 in the direction of center 17, the blanket 14 is clamped and tensioned around the periphery 20 of the blanket cylinder 1.

If clamp bars 48, 49 are used, having a length equal to the width of the several clamping blocks, it will suffice that compression springs, for example, screw-shaped or V-shaped leaf springs, are provided at either clamp bar 48, 49 extremity.

Figure 9:
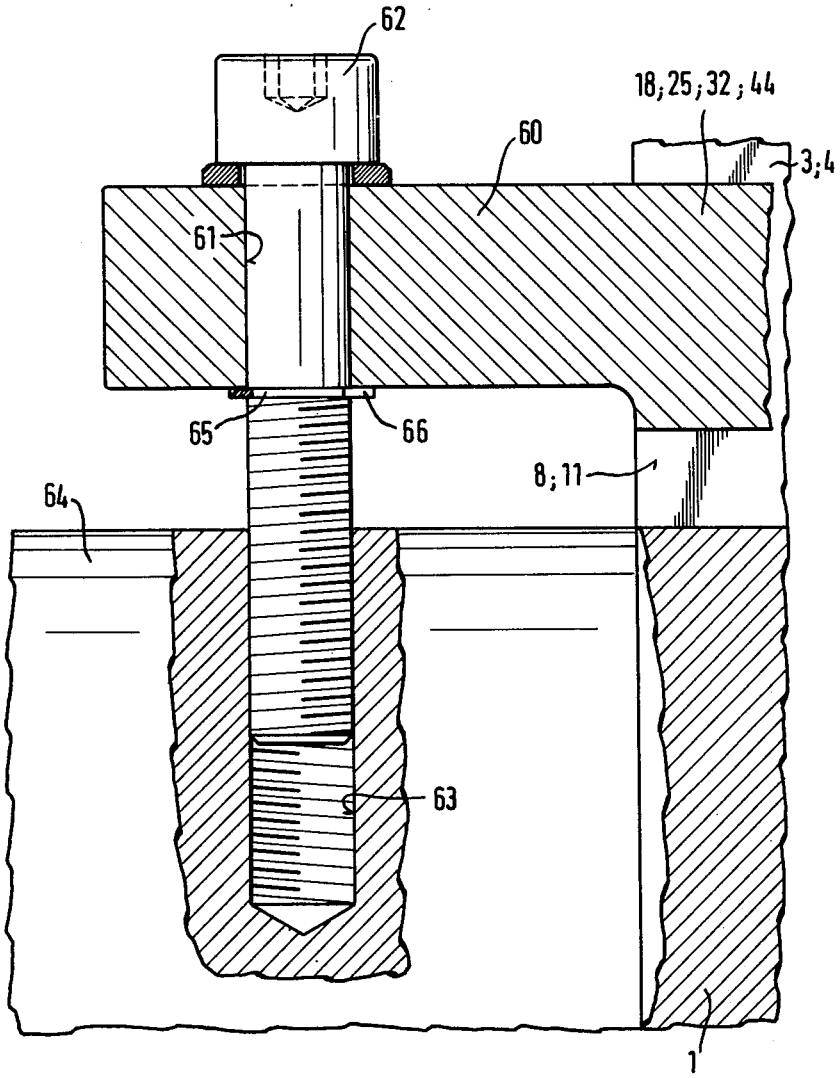
FIG. 9 is a schematic side view, partly in section of an end of a blanket cylinder assembly such as shown in FIG. 1, and showing the means for securing a clamp bar assembly in a desired position in the blanket cylinder.

For the purpose of moving the clamp bar assemblies 18, 25, 32, 44 in the direction of "blanket-clamping" or "blanket-releasing," the clamp bar assemblies 18, 25, 32, 44 are, as may be seen in FIG. 9, each equipped at either side with a shoulder 60 which extends longitudinally out of chamber 7 beyond blanket cylinder 1 and which is fitted with a bore 61. The shaft of a cylinder head screw 62 with an internal hexagon head is received by bore 61 with its thread meshing with the internal thread of a bore 63 in shaft journal 64. A retaining ring 66 is clamped into the groove 65. The right hand and the left hand devices for moving the clamp bar assemblies 18, 25, 32, 44 are identical. In order to simplify matters, only the left hand device is shown in FIG. 9. Actuation of screw 62 causes shoulder 60 and hence clamp bar assembly 18, 25, 32 or 44 to move either radially inwardly or outwardly within chamber 7 of the blanket clamping cylinder 1 thereby effecting clamping and tensioning of the blanket on the cylinder.

While there have hereinabove been fully disclosed preferred embodiments of a blanket clamping and tensioning apparatus in accordance with the present invention, it will be obvious to one or ordinary skill in the art that a number of changes to the apparatus could be made without departing from the true spirit and scope of the invention and accordingly the invention is to be limited only by the appended claims.

I claim:

1. A blanket clamping and tensioning apparatus for a blanket cylinder having an axially extending groove at its periphery, said clamping and tensioning apparatus comprising:

at least two spaced inserts in said axial groove, said inserts having inner surfaces which cooperate with an inner surface of said axially extending groove to define a chamber within said blanket cylinder, said inserts being spaced from each other to provide an axial gap open at the periphery of said cylinder and extending to said chamber, the edges of a blanket being receivable within said gap to extend therethrough and into said chamber;

a camming surface formed on said inner surface of each of said inserts;

a clamp bar assembly in said chamber for clamping said blanket edges, said clamp bar assembly including a slot for receiving said blanket edges, said clamp bar assembly being radially movable and having means contacting said camming surfaces for movement thereby upon radial movement of said clamp bar assembly to effect clamping of said blanket edges within said slot and tensioning of said blanket; and means to secure said clamp bar assembly in a desired position.

2. The apparatus of claim 1 wherein said clamp bar assembly is generally U-shaped, said blanket edges being receivable within said U.

3. The apparatus of claim 2 wherein a plurality of bores are provided in the sides of said U-shaped clamp bar assembly.

4. The apparatus of claim 3 wherein a plurality of clamping means are carried in said bores, said clamping means including balls which contact said camming surfaces.

5. The apparatus of claim 4 further wherein said clamping means includes a plurality of cylindrical pins, said cylindrical pins contacting said edges of said blanket.

6. An apparatus according to claim 5, in which balls are disposed between each of the camming surfaces and the cylindrical pins.

7. An apparatus according to claim 6, in which compression springs are disposed between the balls and the cylindrical pins.

8. The apparatus of claim 1 wherein said clamp bar assembly includes a base plate extending across said chamber and being generally parallel to said axially extending groove of said blanket cylinder.

9. The apparatus of claim 8 further wherein said base plate carries at least two slidable clamping blocks, each of said clamping blocks being slidable in guides generally perpendicularly to said axial groove of said blanket cylinder.

10. An apparatus according to claim 9, in which compression springs are disposed between the clamping blocks which are located opposite to each other.

11. The apparatus of claim 9 further wherein said clamping blocks include recesses which carry means to contact said camming surfaces.

12. The apparatus of claim 8 further wherein said base plate carries at least two clamping blocks, said clamping blocks being hingedly connected to said base plate.

13. An apparatus according to claim 12, in which compression springs are disposed between the clamp bar assembly and the clamping blocks.

14. The apparatus of claim 12 further wherein said clamping bars include recesses which carry means to contact said camming surfaces.

15. The apparatus of claim 14 wherein said clamping blocks include spring means to bias said clamping bars to an unclamped position.

16. An apparatus according to claim 1, in which the clamping means includes cylindrical pins.

17. An apparatus according to claim 1, in which the clamping means includes elements having a circular cross section.

18. The apparatus of claim 1 wherein said chamber has a cross section which decreases in width toward the center of the blanket cylinder.

* * * * *

UNITED STATES PATENT AND TRADEMARK OFFICE

CERTIFICATE OF CORRECTION

PATENT NO. : 4,122,774
DATED : October 31, 1978
INVENTOR(S) : Hartmut K. Sauer

It is certified that error appears in the above-identified patent and that said Letters Patent are hereby corrected as shown below:

In Claim 14, line 2, after the word "clamping" the word "bars" should be changed to read --blocks--.

Signed and Sealed this

*Second* Day of *January 1979*

[SEAL]

*Attest:*

RUTH C. MASON
*Attesting Officer*

DONALD W. BANNER
*Commissioner of Patents and Trademarks*